US006502329B1

(12) United States Patent
Silagy

(10) Patent No.: US 6,502,329 B1
(45) Date of Patent: Jan. 7, 2003

(54) FOOTWEAR ARTICLE USING A CRISS-CROSSING LACING PATTERN

(76) Inventor: Howard Silagy, 100A Tec St., Hicksville, NY (US) 11801

( * ) Notice: Subject to any disclaimer, the term of this patent is extended or adjusted under 35 U.S.C. 154(b) by 0 days.

(21) Appl. No.: 09/433,752

(22) Filed: Nov. 4, 1999

(51) Int. Cl.[7] ..... A43C 11/00
(52) U.S. Cl. ..... 36/50.1; 36/50.5; 24/713.4
(58) Field of Search ..... 36/50.1, 50.5; 434/397; 12/142 LC; 24/713.4, 713.3, 713.6, 712.1, 714.5

(56) References Cited

U.S. PATENT DOCUMENTS 571,749 A * 11/1896 Colton ..... 24/713.5
1,466,673 A * 9/1923 Solomon ..... 24/713.3
1,469,661 A * 10/1923 Migita ..... 24/712.1
1,697,893 A * 1/1929 Winlow ..... 24/713.3
1,995,243 A * 3/1935 Clarke ..... 24/713.3
2,287,985 A * 6/1942 Gookin ..... 36/50.1
3,333,304 A * 8/1967 Daddona, Jr. ..... 36/50.1
3,834,048 A * 9/1974 Maurer ..... 36/50.5
4,458,373 A * 7/1984 Maslow ..... 36/50.1
4,633,548 A * 1/1987 Siskind et al. ..... 36/50.1
5,566,474 A * 10/1996 Leick et al. ..... 36/50.5

* cited by examiner

*Primary Examiner*—Mickey Yu
*Assistant Examiner*—Troy Arnold
(74) *Attorney, Agent, or Firm*—Myron Amer, P.C.

(57) ABSTRACT

After purchase of a footwear article of manufacture, such as a sneaker, boot or the like, the substitution for the traditional lacing-up of the article of studs and lace of elastomeric construction material in a criss cross pattern to facilitate the fitting on and removal of the article from a user's foot.

1 Claim, 1 Drawing Sheet

FOOTWEAR ARTICLE USING A CRISS-CROSSING LACING PATTERN

The present invention relates generally to footwear having a facilitated lacing system, and more particularly to the application of the lacing system in a desired crisscrossing pattern to a boot or sneaker in which the attributes of an elastic shoelace are used to advantage.

The elastic construction material of the shoelace is useful primarily so that when in a crisscross pattern, the user can widen the shoe front opening manually and the elastic will give accordingly. Elasticity also closes the opening after replacing the shoe on the foot.

EXAMPLE OF THE PRIOR ART

The utilitarian contribution of a shoelace of an elastic construction material is well documented in the prior art, as exemplified by U.S. Pat. No. 5,640,785 issued to Sinisa Egelja for "Resilient Loops and Mating Hooks For Securing Footwear To A Foot" on Jun. 24, 1997. This patent discloses the use of plural hooks or studs, either permanently or replaceable located along the edges of the shoe front flaps. Cooperating with the studs are plural closed loops of elastomeric construction material in which the free ends of the loops are adapted to be secured to a cooperating stud(s) and the opposite loop ends are, as provided in the an OEM condition, permanently attached to the upper.

It can be assumed that individual closed loops rather than a more preferred crisscrossing pattern in the deployment of the shoelace was used because of the difficulty of doing so using an elastic shoelace. This is a consequence in a crisscrossing lace pattern of length portions of the shoelace being trapped beneath the front flaps and the tongue and thusly held by friction and gripping forces against movement which is required in response to a user pulling up on the shoelace during the lacing closed of the front opening of the boot or sneaker. The closed elastic loops of the '785 patent retains the benefits of elasticity in the shoelace, but at the expense of foregoing the use of a crisscrossing lace pattern and its contribution to greater comfort.

Broadly, it is an object to provide an elastic shoelace deployed in a crisscrossing pattern overcoming the foregoing and other shortcomings of the prior art.

More particularly, it is an object to achieve the deployment without friction and like forces inhibiting desired movement of the shoelace in the lacing-up procedure, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Method aspects of the present invention, as will be subsequently described in detail, are concerned with the lacing closed of a front opening of a footwear article of manufacture exemplified by a boot and a sneaker in which there is a partial closing by an extension thereinto of cooperating left and right flaps, and proposes the improvement consisting of a method of completing the closing by the urging of the left and right flaps in closing movement towards each other, all to the end of achieving a preferred shoelace crisscrossing pattern in a facilitated manner.

Figure 1:
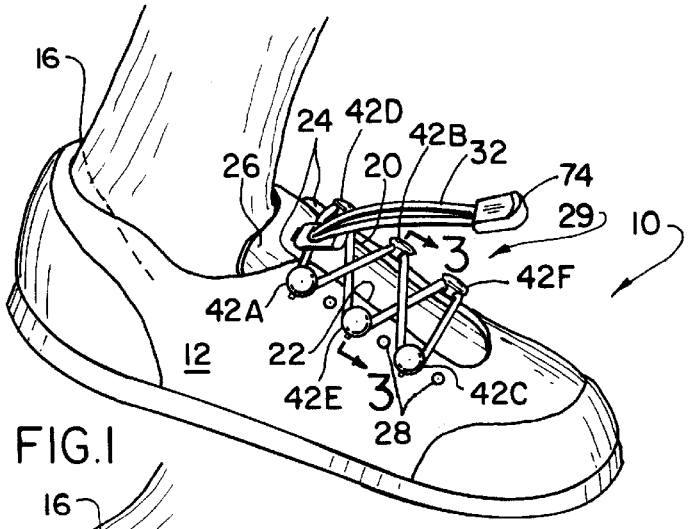
FIG. 1 is a perspective view of a boot fitted onto a user's foot preparatory to walking use.
Figure 2:
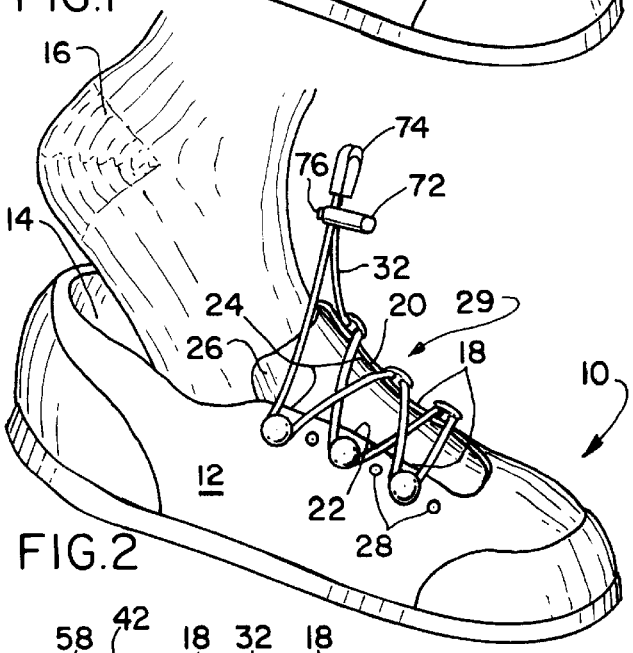
FIG. 2 is a view similar to FIG. 1 but illustrating the fitting procedure resulting in the boot condition of FIG. 1.

Shown in FIGS. 1 and 2, is a walking or sport boot, generally designated 10, having an upper 12 which bounds a foot-receiving compartment 14 for receiving thereinto (FIG. 2) and removing therefrom a foot 16 of a user, wherein edges 18 located along the periphery of a left front flap 20 and a right front flap 22 bound a front opening 24 into the compartment 14. A tongue 26 is attached to extend lengthwise of the opening 24 but, as generally known, it is provided mainly for comfort and appearance, and the lacing closed of the opening is a primary function of the cooperating left and right front flaps 20, 22.

Figure 4:
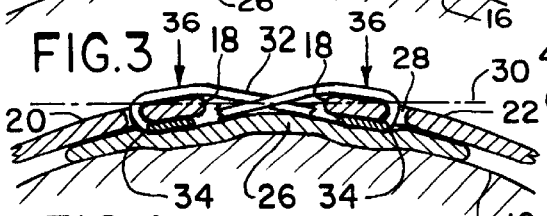
FIG.4 PRIOR ART
FIG. 4 is a cross sectional view similar to FIG. 3, but illustrating a condition of the lacing of the boot prevalent in the prior art.

In each peripheral flap edge 18, there are provided conventional shoelace keeper-openings, individually and collectively designated 28, being in active use herein three in number in each flap 20, 22 and thus six in total. As a consequence, the user is provided the option of establishing a crisscrossing lace pattern 29 in a first plane 30 coincident to the plane of the flaps 20, 22, by threading a shoelace 32 in the desired crisscrossing pattern 29 through the shoelace keeper-openings 28. FIG. 4 illustrates the exercise of this option, which it is to be noted is the option of choice of the prior art, and the exercise of which unavoidably traps length portions 34 of the shoelace 32 between the flaps' peripheral edges 18 and the tongue 26, with the consequence of giving rise to a frictional force 36 inhibiting movement of the shoelace 32 in response to the user pulling up on the shoelace during the lacing closed of the front opening 24.

In accordance with the present invention, a user is provided another option of establishing a crisscrossing lace pattern 29 in a second plane 38 coincident with the plane of shoelace keeper loops, individually and collectively designated 40. Each shoelace keeper-loop 40 is an integral structural feature of a stud, individually and collectively designated 42, except in FIGS. 5 and 6 in which the designated studs 42 are followed by letters to distinguish therebetween. Each said stud consists of a medial cylindrical body 44 having an upper enlarged diameter shape 46 and a base with an enlarged diameter shape 48 and the noted loop 40 connected in spanning relation, as at 50 and 52, between the shapes 46, 48.

Figure 3:
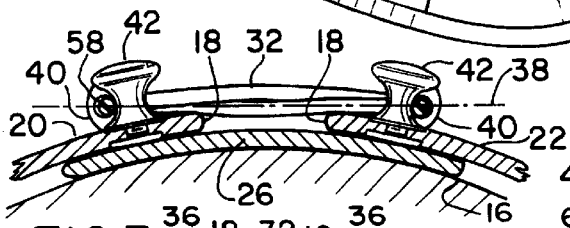
FIG. 3 is a cross sectional view taken along line 3—3 of FIG. 1.
Figure 6:
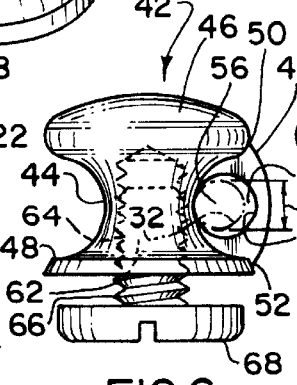
FIGS. 6 and 7 are respectively isolated front and side views of a shoelace-keeper component of the present invention.
Figure 7:
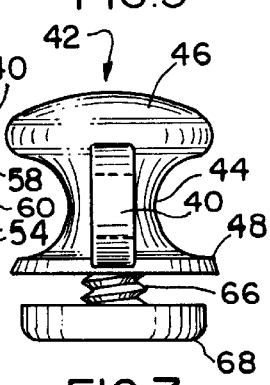

As best understood from FIGS. 3, 6 and 7, the edge 54 of each loop bounds a size in the opening 56 which is selected to provide a movement clearance 58 for the shoelace 32, which is a consequence of the size differences between the diameter 60 of the shoelace 32 and the shoelace keeper-opening 56, to the end of obviating any frictional resistance to movement at any locations along the length of the shoelace 32 during the lacing up procedure. To use to maximum advantage the frictionless lacing-up procedure, as just described, it is recommended that the shoelace 32 be of elastic construction material so that there is appropriate expansion and contraction in the shoelace 32 which, in practice, it has been found to effectively obviate localized pressure points as might contribute to discomfort during the walking use of the boot 10.

It is to be understood however, that a user might elect to use a shoelace of fabric or leather construction material and achieve the partial, but nevertheless, significant benefit of a facilitated lace-up procedure.

Each stud 42 has an internally threaded blind opening 62 which threadably engages, as at 64, a threaded shank 66 of a screw 68. The exercising of the option of establishing a crisscrossing pattern in the plane 38 while using an elastic shoelace 32, is best understood from FIG. 5. Prior to the closed loop configuration 70 assumed by the elastic shoelace 32, the shoelace is threaded through the keeper-openings 40, and the free ends then receive an appropriate slide 72 and are connected together by an appropriate clamp 74. The preferred slide 72 is of the type normally closed under spring urgency against the shoelace threaded therethrough, and released to partake of sliding movement when a spring-deactivating button 76 is depressed. The preferred clamp 74 is one having a shaped body effective to serve as a convenient finger grip when pulling up on the shoelace.

Figure 5:
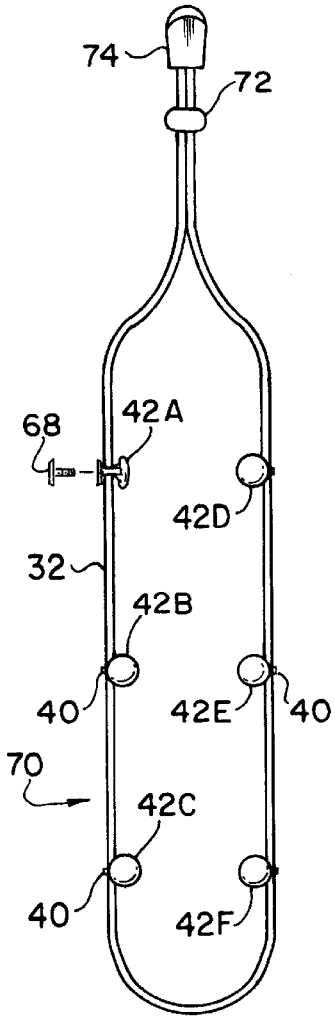
FIG. 5 is an isolated simplified plan view of an elastic shoelace assembly prior to use in the establishment of a crisscrossing lacing pattern as illustrated in FIGS. 1, 2.

Still referring to the assembly of FIG. 5, in which letters A–F are added to the numerical designation 42 of the studs in alphabetical order, the preferred sequence of applying the closed loop 70 to the boot 10 is to secure stud 42E in the third from the top vacant opening in the right front flap 22, followed by securing studs 42D and 42F in respective spaced apart vacant lace openings 28 in the left front flap 20, followed by securing stud 42B in between the secured studs 42D and 42F, and completing the sequence by securing in place studs 42A and 42C in spaced apart vacant lace openings in the right front flap 22. For comparison of FIGS. 1 and 5 and better understanding of the deploying of the studs, the number/letter designations used for the studs in FIG. 5 have been duplicated in FIG. 1.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In the lacing closed of a front opening of a footwear article of manufacture exemplified by a boot and a sneaker in which there is partial closing by an extension thereunto of cooperating left and right flaps, the improvement consisting of a method of completing said closing in the urging of said left and right flaps in closing movement towards each other comprising the steps of:

(1) establishing sites for a crisscrossing lacing pattern in a first plane of said flaps using walls bounding empty lacing openings in confronting peripheral edges thereof;

(2) establishing a crisscrossing lacing pattern correlated to said established sites in a second plane in a clearance position above said first plane using integral configurations of loops bounding empty openings in keeper members having threadably attachable bases disposed in said lacing openings in said confronting peripheral edges of said flaps; and (3) threading a lace in a crisscrossing pattern using said keeper members' loops; whereby, a clearance position of said second plane above said first plane facilitates establishment of said crisscrossing lacing pattern.

* * * * *